US009197955B2

(12) United States Patent
Peissig

(10) Patent No.: US 9,197,955 B2
(45) Date of Patent: Nov. 24, 2015

(54) MICROPHONE UNIT

(71) Applicant: Sennheiser electronic GmbH & Co. KG, Wedemark (DE)

(72) Inventor: Juergen Peissig, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/754,776

(22) Filed: Jun. 30, 2015

(65) Prior Publication Data

US 2015/0304752 A1 Oct. 22, 2015

Related U.S. Application Data

(62) Division of application No. 13/082,777, filed on Apr. 8, 2011, now Pat. No. 9,107,007.

(30) Foreign Application Priority Data

Apr. 9, 2010 (DE) ..... 10 2010 003 837

(51) Int. Cl.
*H04R 1/08* (2006.01)
*H04R 3/00* (2006.01)

(52) U.S. Cl.
CPC ... *H04R 1/08* (2013.01); *H04R 3/00* (2013.01)

(58) Field of Classification Search
CPC ..... H04R 1/08; H04R 1/083; H04R 1/20; H04R 1/22; H04R 1/32; H04R 3/005; H04R 25/407
See application file for complete search history.

(56) References Cited

U.S. PATENT DOCUMENTS

| | | | |
|---|---|---|---|
| 3,190,972 | A | 6/1965 | Schoeps et al. |
| 5,524,059 | A | 6/1996 | Zurcher |
| 6,249,586 | B1 | 6/2001 | Stoffel et al. |
| 6,418,229 | B1 | 7/2002 | Staat |
| 6,507,659 | B1 | 1/2003 | Iredale et al. |
| 8,526,633 | B2 | 9/2013 | Ukai et al. |
| 2006/0204023 | A1 | 9/2006 | Stinson et al. |
| 2008/0051920 | A1 | 2/2008 | Hori |
| 2009/0290741 | A1 | 11/2009 | Daley et al. |

FOREIGN PATENT DOCUMENTS

| | | |
|---|---|---|
| DE | 11 71 960 | 6/1964 |
| DE | 43 07 825 | 10/1997 |
| DE | 197 06 074 | 6/1998 |
| DE | 199 00 969 | 8/2003 |

*Primary Examiner* — Ping Lee
(74) *Attorney, Agent, or Firm* — Frommer Lawrence & Haug LLP

(57) ABSTRACT

There is provided a microphone unit having a plurality of miniature microphones for respectively recording audio signals and a carrier unit. The miniature microphones can be arranged on a side of the carrier unit.

11 Claims, 9 Drawing Sheets

MICROPHONE UNIT

The present application is a divisional of U.S. patent application Ser. No. 13/082,777 filed on Apr. 8, 2011, which claims priority from German Patent Application No. DE 10 2010 003 837.7 filed on Apr. 9, 2010, the disclosure of which is incorporated herein by reference in their entirety.

BACKGROUND OF THE INVENTION

1. Field of the Invention

The present invention concerns a microphone unit having a plurality of miniature microphones.

2. Description of Related Art

Miniature microphones have been known for some time and are used in various areas of application. By virtue of their structural form the miniature microphones have physical limits in regard to effectiveness in electroacoustic conversion. In that respect miniature microphones have in particular limitations in terms of frequency response characteristic, in respect of volume dynamic range, directional characteristic and the inherent noise characteristic. Typically miniature microphones are used as individual microphones in the field of speech communication devices as here the demands on transfer cycle, distortion factor, dynamic range and directional characteristic are low.

As general state of the art attention is directed to DE 199 00 969 C2, DE 197 06 074 C1, DE 43 07 825 C2, DE 11 71 960 A and US 2009/0290741 A1.

SUMMARY OF THE INVENTION

Therefore an object of the present invention is to provide a microphone unit having a plurality of miniature microphones which permit use of miniature microphones even in areas of use demanding high quality.

Thus there is provided a microphone unit having a plurality of miniature microphones for respectively recording audio signals and a carrier unit. The miniature microphones can be arranged on a side of the carrier unit.

In an aspect of the present invention the carrier unit has a perforation region in which there is provided an acoustic impedance.

In a further aspect of the present invention the carrier unit is provided in the form of a carrier plate having a front side and a rear side. A first plurality of miniature microphones can be provided on the front side and a second plurality of miniature microphones can be provided on the rear side. An attenuation unit and/or an alternate routing unit can be provided in front of the rear side of the carrier plate.

In a further aspect of the invention the carrier unit is in the form of a carrier plate having a plurality of bores or acoustic inlets. The first plurality of miniature microphones is arranged on the front side in such a way that it closes an end of the bores. The second plurality of miniature microphones is provided on the rear side in such a way that it closes an end of the bores.

In a further aspect of the invention the microphone unit has at least one resonator in front of the front and/or rear side of the carrier unit. The at least one resonator is acoustically coupled to the microphone inlets.

In a further aspect of the invention there are provided at least two resonators on the front and/or rear side and a respective resonator is acoustically coupled to a partial segment of the plurality of miniature microphones.

In a further aspect of the invention there is provided an interference tube. The interference tube is arranged in front of the front side or the rear side of the carrier plate and is acoustically coupled to the microphone unit.

In a further aspect of the invention the microphone unit has at least a first and a second carrier plate each having a front and a rear side. The miniature microphones are arranged on the front and/or rear side of the first and second carrier plates. The microphone unit further has an intermediate wall between the first and second plates, a first opening which connects a volume between the second carrier plate and the intermediate wall to an external volume, and a second opening which connects a volume between the intermediate wall and the first carrier plate to the external volume.

In a further aspect of the invention there is provided a first summing unit for summing the output signals of the first plurality of microphone units on the front side of the carrier plate and a second summing unit for summing the output signals of the second plurality of microphone units on the rear side of the carrier plate, a third summing unit for subtracting the output signals of the first and second summing units and a delay unit for delaying the output signals of the first or second summing unit.

In a further aspect of the invention the microphone unit has a multiplicity of time delay units for time delay of the output signals of the second plurality of miniature microphones and a plurality of summing units for subtracting the output signals of the first plurality of miniature microphones from the time-delayed output signals of the second plurality of miniature microphones.

In a further aspect of the invention the first and second plurality of miniature microphones are respectively divided into at least two segments which can be processed at least partially independently of each other.

By virtue of the microphone unit according to the invention the membranes in dynamic, electrostatic or electret microphones can be replaced by a multiplicity of miniature microphones.

In that respect the properties of the dynamic, electrostatic or electret microphones can be emulated. Such emulation can be effected based on the frequency response characteristic, the directional characteristic, the close-talk effect, the noise performance, the limit sound pressure level for tolerable distortion and the sensitivity to solid-borne sound.

By virtue of the microphone unit according to the invention modelling of the noise performance can be effected by a suitable arrangement of the miniature microphones in an array and by interconnection of the output signals of the respective miniature microphones. In an aspect of the invention modelling of the limit sound pressure level of the multiplicity of miniature microphones can be effected by coupling of attenuation materials and/or passive resonators between an exciting sound field and the microphone units. In an aspect of the invention modelling of the sensitivity in respect of solid-borne sound can be effected by a suitable arrangement and mounting of the miniature microphones so that the solid-borne sound signals of the miniature microphones cancel each other out and the signal voltages of the individual miniature microphones however do not cancel each other out. In an aspect of the invention modelling of the frequency response characteristic of a microphone unit according to the invention can be effected by coupling acoustic transit time members, resonators or attenuation units. In an aspect of the invention modelling of the frequency response characteristic of the microphone unit can be provided by coupling suitable acoustic surfaces with defined acoustic impedance jumps.

In an aspect of the invention modelling of the difference sound pressure-frequency response characteristic between the front and rear side of a carrier on which the miniature microphones are provided can be made possible by coupling different resonators on the front and/or rear side.

In a further aspect of the invention modelling of the directional properties can be effected by coupling passive acoustic directional tubes.

In a further aspect of the invention modelling of the directional characteristics of one or more miniature microphones can be effected according to the invention by electrical interconnection of the output signals of spatially separate microphone units.

In a further aspect of the invention modelling of directional properties can be effected by placement of a microphone unit on an acoustically tuned material for making use of pressure increase and impedance jumps.

In a further aspect of the invention modelling of directional properties of the microphone unit can be effected by segmentation of the microphone unit and individual interconnection of the output voltages of the segments after filtering by analog or digital LTI systems.

In a further aspect of the invention modelling of the close-talk effect can be effected by adjusting the degree of the directional properties by selection of the transmission of the carrier material and/or alternate routing properties.

The invention concerns the notion of connecting a microphone unit having a multiplicity of miniature microphones to passive acoustic units for influencing the frequency response characteristic and the directional property of the microphone unit or a multiplicity of microphone units.

In that respect the miniature microphones serve as "elementary" membranes. Conventional membrane elements are always mechanically coupled. Elementary membranes arranged in that way are electrically coupled in accordance with the invention. Electrical coupling allows more manipulation options than mechanical coupling of elementary membrane portions (such as time delay and/or filtering prior to electrical coupling (LTI)).

Further configurations of the invention are subject-matter of the appendant claims.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
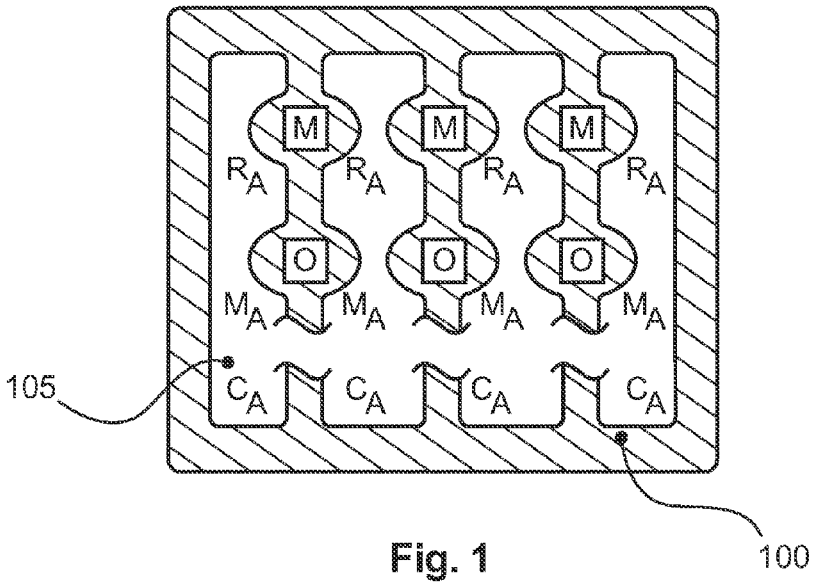
FIG. 1 shows a diagrammatic view of a microphone unit having a multiplicity of miniature microphones in accordance with a first embodiment.

FIG. 1 shows a diagrammatic view of a microphone unit according to a first embodiment. The microphone unit has a multiplicity of miniature microphones M for example on a printed circuit board or another carrier. The printed circuit board can have regions having a defined acoustic resistance RA. That acoustic resistance can serve for setting the acoustic impedance of the arrangement. The reflection factor of the arrangement can also be adjusted by adjusting the impedance. The acoustic resistance RA can be implemented in the form of a perforation in the circuit board. The miniature microphones M and O can be provided in one or various planes and can be disposed on the front side (M) and the rear side (O).

Optionally there can be provided adjustable acoustic resistors to adjust a degree of the acoustic short-circuit between a front and a rear side of the microphone unit. Accordingly the sound pressure difference between the front side and the rear side and in conjunction therewith the directional characteristic and the frequency response characteristic can also be adjusted by the adjustable acoustic resistor.

Figure 2A:
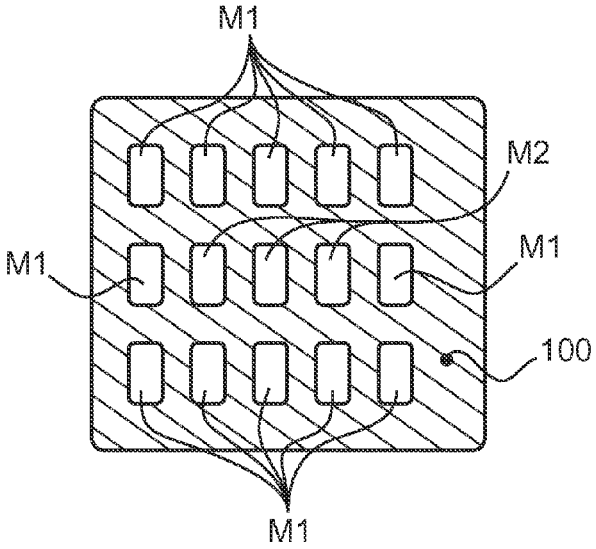
FIGS. 2A and 2B each show a view of a microphone unit in accordance with a second embodiment.
Figure 2B:
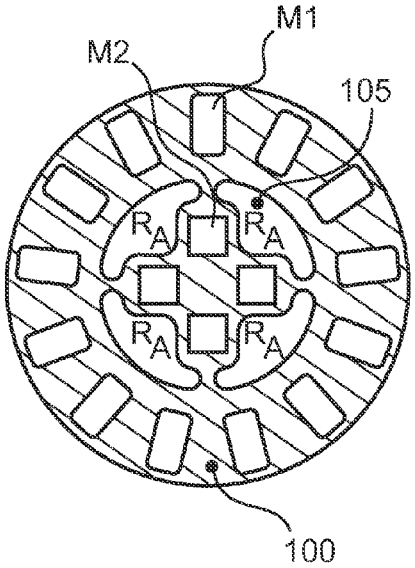

FIG. 2A shows a diagrammatic view of a microphone unit according to a second embodiment. In this case a microphone unit of a rectangular configuration is shown in FIG. 2A. FIG. 2B shows a microphone unit of a round configuration. The miniature microphones M can be divided for example into two segments, namely first miniature microphone segments M1 and second miniature microphone segments M2. In FIG. 2A the second miniature microphones M2 are provided in the interior of the array or assembly while the first miniature microphones M1 are provided on the outside. A corresponding consideration applies to the microphone unit in FIG. 2B. In addition for example the miniature microphones M1 from the first segment and the second miniature microphones M2 from the second segment can be suitably combined or connected together. To influence the directional characteristic and/or the frequency response characteristic of the microphone unit the first and second segments can be acoustically and/or electrically interconnected. Optionally the first and second segments can be provided on different planes to produce different transit times for different sound incidence directions.

Figure 3:
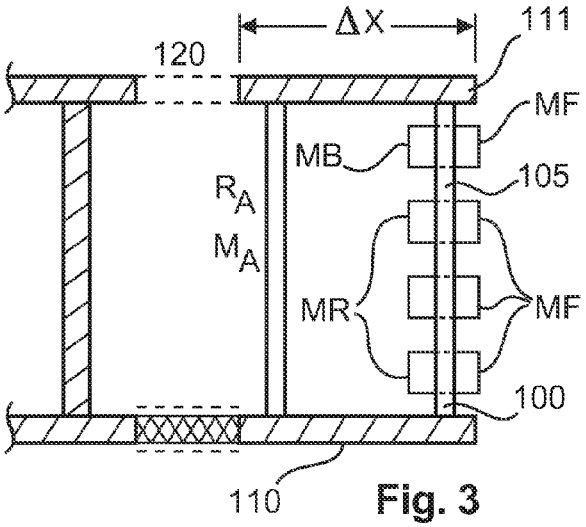
FIG. 3 shows a diagrammatic view of a microphone unit according to a third embodiment.

FIG. 3 shows a diagrammatic view of a microphone unit according to a third embodiment. The microphone unit has a housing 110 and a carrier plate 100. The carrier plate can have a multiplicity of miniature microphones MF, MR, wherein a number of the miniature microphones MF are provided on the front side and a number of the miniature microphones MR are provided on the rear side. There can also be an acoustic resistor 120 to close off a rear volume (in front of the rear side). The miniature microphones MF at the front side and the miniature microphones MB at the rear side respectively record the sound with a corresponding sound pressure. If the sound inlet of the microphones MF and MR is provided through the carrier plate then the miniature microphones MF and MR must be arranged in displaced relationship.

In this case the front side or the rear side of the microphone unit can represent the side towards the housing or the side opposite the mounting side of the housing.

Figure 4A:
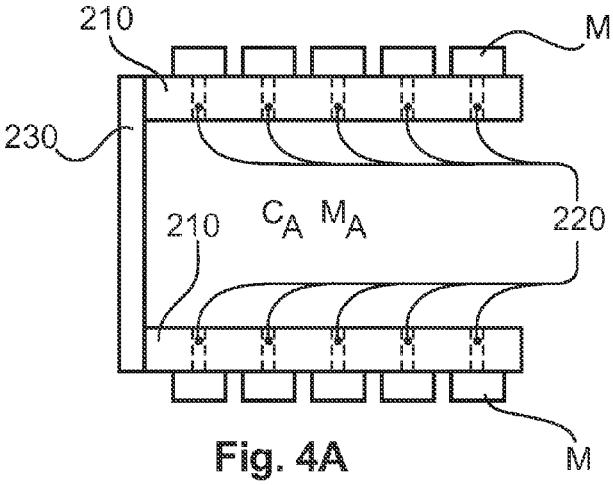
FIGS. 4A through 4D show various views of a microphone unit according to a fourth embodiment.
Figure 4B:
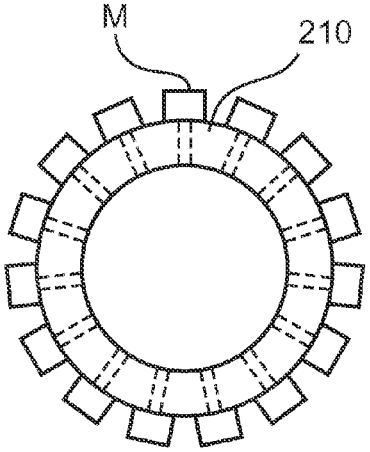

FIGS. 4A through 4D each show various diagrammatic views of the microphone unit according to a fourth embodiment. In particular a three-dimensional orientation or arrangement of the microphones is shown here. FIG. 4A shows a diagrammatic cross-section of a microphone unit. In this case the microphone unit has for example a housing in the form of a hollow cylinder or a tube 210 having a removable end portion 230. A multiplicity of miniature microphones M can be provided on the housing 210. In this case the miniature microphones can be provided externally on the housing 210 if the sound inlet 220 is through the carrier plate.

Figure 4C:
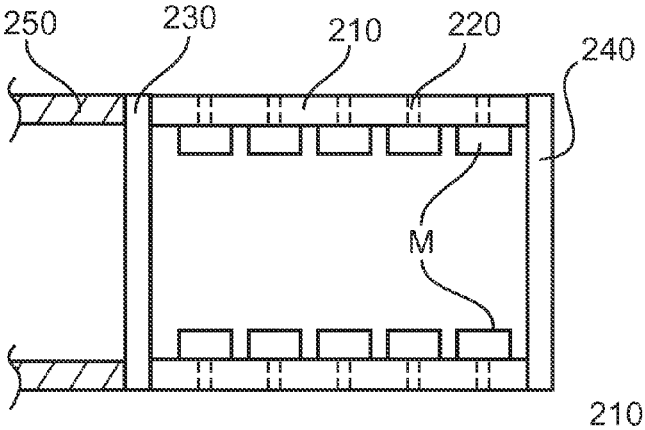
Figure 4D:
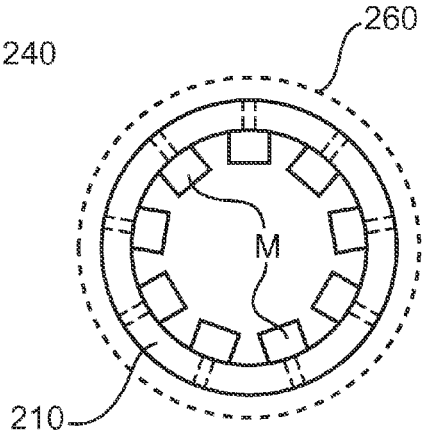

FIG. 4C also shows a diagrammatic sectional view of the microphone unit. The microphone unit also has a housing in the form of a hollow cylinder or tube 210 having a multiplicity of miniature microphones M arranged on the inside of the housing 210. The housing 210 has a first end, to which it is coupled with a handle 250. A removable cap 240 can be provided on the other side. Optionally an acoustically transparent protective fabric 260 can be provided around the housing 210 and can also serve as pop protection.

No pressure increase occurs with the microphone unit shown in FIGS. 4A through 4D in the event of frontal talk thereinto and the microphone unit has approximately identical acoustic properties for laterally rotationally symmetrical sound incidence. That determines the resulting directional characteristic. The housing 210 can be in the form of a tube and can be open or closed. The tube has an acoustic resistance $C_A$ or $M_A$ in dependence on the diameter and the closed or opened end portion 230.

Figure 5:
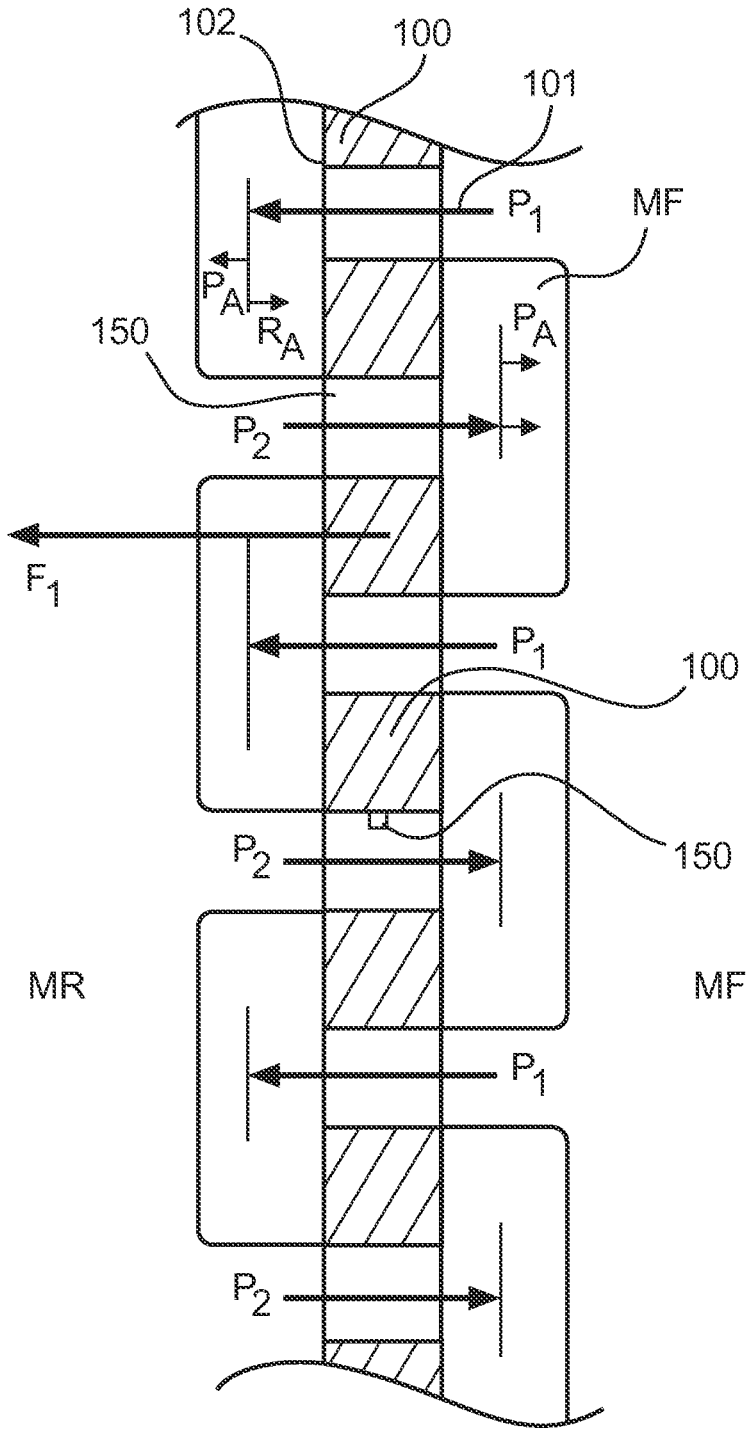
FIG. 5 shows a diagrammatic portion of a microphone unit according to a fifth embodiment.

FIG. 5 shows a diagrammatic sectional view of a part of a microphone unit according to a fifth embodiment. The microphone unit has a carrier plate 100 having a multiplicity of bores (acoustic inlets) 150. The carrier plate 100 further has a front side 101 and a rear side 102. Provided on the front side 101 of the carrier plate 100 are a plurality of miniature microphones MF which together represent a first plurality MF of miniature microphones. In addition provided on the rear side 102 of the carrier plate 100 is a second plurality MR of miniature microphones M. The miniature microphones are preferably fixed to the carrier plate in such a way that they are provided on the front or rear side 101, 102 respectively over a bore 150 or cover an end of the bore. In particular the miniature microphones M1 can be so arranged that they alternately cover a bore on the front and rear sides 101, 102 of the carrier plate 100. A first pressure signal P1 acts in the bore 150 closed at the rear side 102 and a second positive pressure signal acts in the bore 150 closed at the front side 101. Those positive first and second pressure signals P1, P2 respectively produce a positive output signal of the respective miniature microphones M.

A force F1 can act on the carrier plate 100 and can lead to acceleration of the carrier plate 100. The force F1 can be produced for example by solid-borne sound. The acceleration accompanying the force F1 also has an effect on the respective miniature microphones M1. An opposite membrane deflection is produced in the sum signal of the respective miniature microphones M on the front and rear sides 101, 102. If the output signals of the miniature microphones M on the front and rear sides are added then the microphone signal, produced by the force F1, of all summed individual signals can be cancelled. That accordingly reduces the microphone signal component which is triggered by solid-borne sound (F1).

Thus there is provided a microphone unit having a carrier plate 100 which has a front side 101 and a rear side 102. A first plurality of miniature microphones M is provided on the front side 101 and a second plurality of miniature microphones M is provided on the rear side 102. The carrier plate 100 further has a plurality of bores 150. Optionally the miniature microphones M can be placed on the front and rear sides 101, 102 over a respective one of the bores 150. Optionally the miniature microphones M on the front and rear sides can be so arranged that the bores are alternately covered by the respective miniature microphones M on the front side 101 and the rear side 102.

Figure 6A:
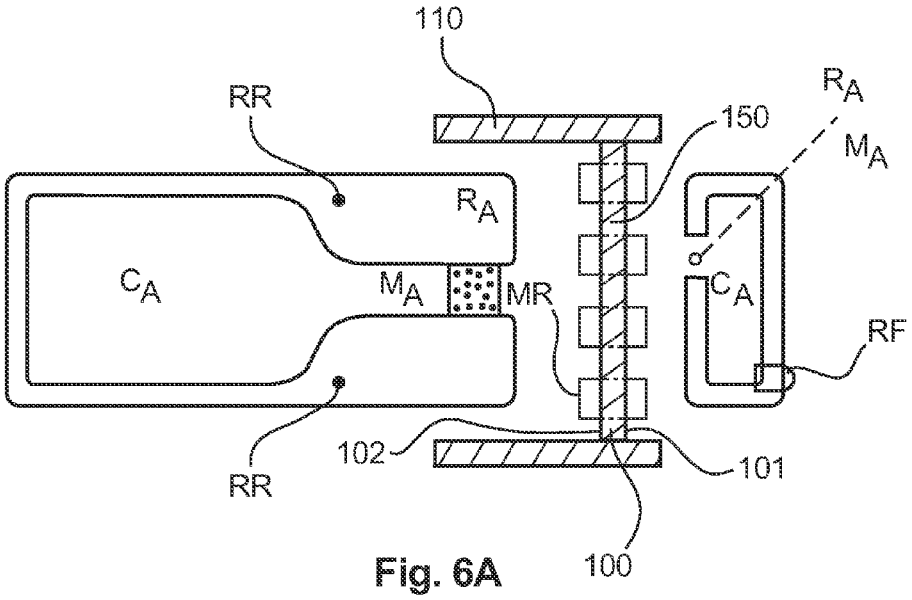
FIGS. 6A and 6B each show a diagrammatic sectional view of a microphone according to a sixth embodiment.
Figure 6B:
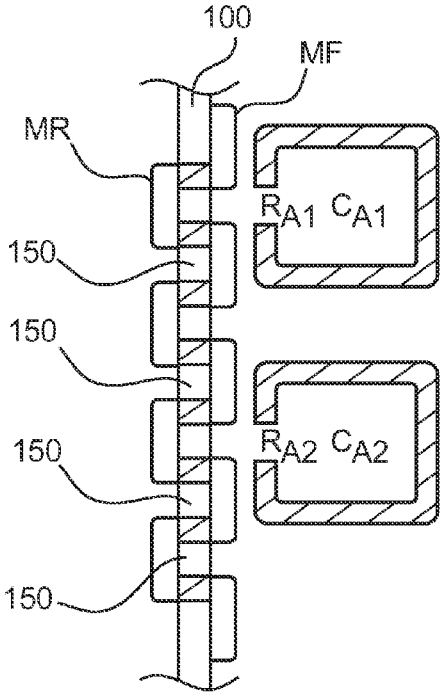

FIGS. 6A and 6B show different diagrammatic views of a microphone unit according to a sixth embodiment. The microphone unit has a carrier plate 100 having a front side 101 and a rear side 102, wherein miniature microphones MF, MR are provided both on the front side and also on the rear side 101, 102. A resonator RR is provided in the region of the front side 101. Optionally a further resonator RR can be provided in the region of the rear side 102.

In FIG. 6B, two resonators RF1, RF2 are provided for example at the front side or the rear side of the carrier plate.

The resonators RF, RR can influence the sound pressure frequency response characteristic of individual miniature microphones or segments of miniature microphones.

While FIG. 6A shows only one resonator on the front side and one resonator RR on the rear side a plurality of resonators RF1, RR1, RF2, RR2 can be provided instead of a single resonator. Each resonator has an acoustic volume $C_A$ and a portion connecting the volume to the external volume. That portion can have the effect of an acoustic resistor $R_A$ and an acoustic mass $M_A$. The acoustic volume and the acoustic portion of the various resonators RF1, RF2, RR1, RR2 can be of different configurations so that different miniature microphones or segments of miniature microphones have different sound pressure relationships. In that way it is possible to influence the difference pressure frequency response characteristic between the front side and the rear side.

Optionally the carrier plate 100 can be provided within a housing or housing portion 110. That housing portion 110 provides an alternate routing path $\Delta x$. A sound pressure difference between the front side and the rear side of the carrier plate 100 can be produced by that alternate routing path. The carrier plate 100 can have for example a bore 150 which can be in the form of an acoustic communication with a defined acoustic impedance. In that way it is also possible to influence the sound pressure difference between the front side and the rear side. Optionally acoustic impedances can be provided in the sound path 150 for tuning of the overall arrangement.

In accordance with the sixth embodiment therefore there is provided a microphone unit having a carrier plate 100, on which there is provided a multiplicity of miniature microphones. The carrier plate has a front side 101 and a rear side 102. A first plurality of miniature microphones MF is provided on the front side 101 and a second plurality of miniature microphones MR is provided on the rear side of the carrier plate 100. An acoustic resonator can be provided in front of the front side 101 and/or behind the rear side 102 of the carrier plate 100 so that the sound pressure frequency response characteristic of at least some of the miniature microphones is influenced by overlapping of the resonator and the miniature microphones M on the front and rear sides. Optionally acoustic communications 150 can be provided in the carrier plate, serving as a sound inlet in the case of bottom-ported microphones. Optionally an acoustic alternate routing path can be provided by a part of the housing 110.

Figure 7:
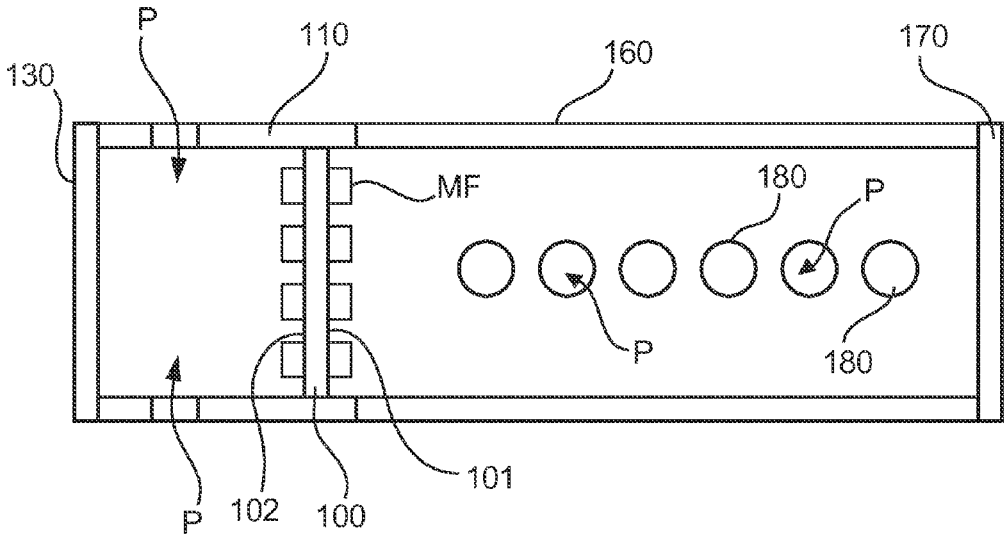
FIG. 7 shows a diagrammatic view of a microphone unit according to a seventh embodiment.

FIG. 7 shows a diagrammatic sectional view of a microphone unit according to a seventh embodiment. The microphone unit has a housing 110 with a carrier plate 100 which has a front side 101 and a rear side 102. A plurality of miniature microphones can be provided both on the front side and also the rear side. The housing 110 can have a removable cap at its first end and an interference tube 160 at its second end (front side). As an alternative thereto the interference tube and the cap can also be interchanged. A plurality of holes 180 can be provided in the interference tube 160. If the output signals of the miniature microphones on the front and rear sides are suitably interconnected it is possible then to adjust the directional characteristic.

Figure 8A:
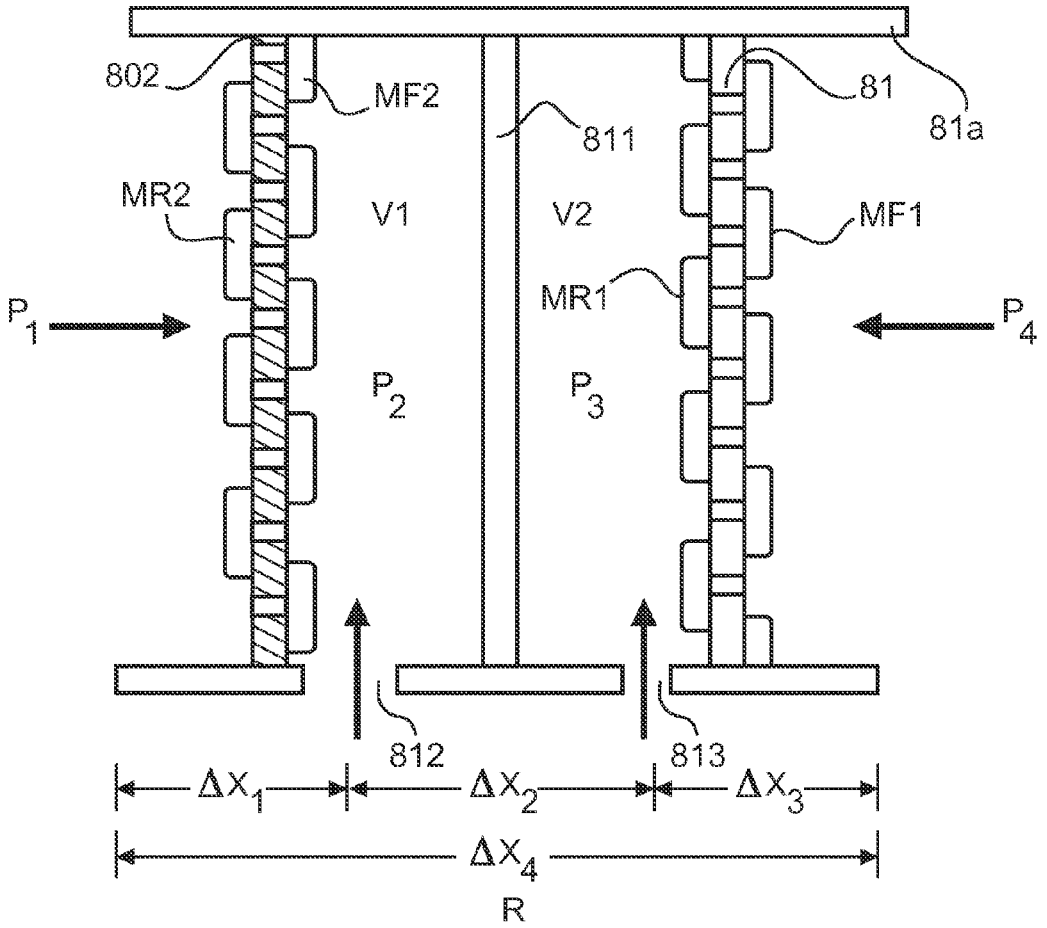
FIGS. 8A and 8B show various views of a microphone unit according to an eighth embodiment.
Figure 8B:
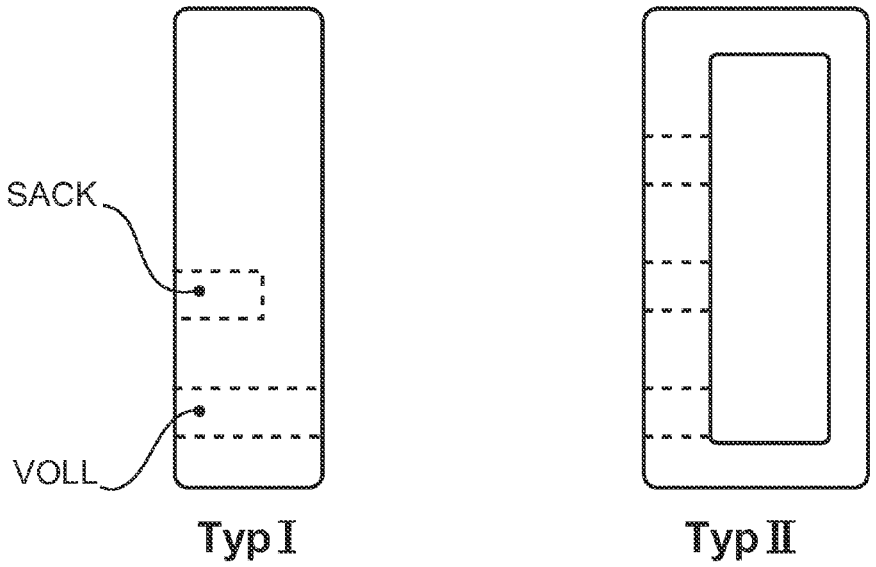

FIGS. 8A and 8B show diagrammatic views of a microphone unit according to an eighth embodiment. The microphone unit has a housing 810 and first and second carrier plates 801, 802. The first and second carrier plates each have a front side and a rear side. A respective plurality of miniature microphones is provided on each of the front and rear sides. The first plurality of miniature microphones MF1 is provided on the front side of the first carrier plate 801 and a second plurality of miniature microphones MR1 is provided on the rear side. A third plurality of miniature microphones MF2 is provided on the front side of the second carrier plate 802 and a fourth plurality of miniature microphones MR2 is provided on the rear side of the second carrier plate 802. Thus there is provided a microphone unit having four planes of miniature microphones. An intermediate wall 811 can be provided between the first and second carrier plates 801, 802. An opening 813 can be provided in the region between the intermediate wall 811 and the first carrier plate 801 and an opening 812 can be provided between the intermediate wall 811 and the second carrier plate 802. Thus there are a first alternate routing path Δx1 between the end of the housing 810 and the opening 812, a second alternate routing path Δx2 between the opening 812 and the opening 813 and a third alternate routing path Δx3 between the opening 813 and the end of the housing 810. Different pressures P1, P2, P3 and P4 act on the front and rear sides of the first and second carrier plates, by virtue of those alternate routing paths. In that case a first pressure P1 acts on the rear side of the second carrier plate 802, a second pressure P2 acts on the front side of the second carrier plate, a third pressure P3 acts on the rear side of the first carrier plate and a fourth pressure P4 acts on the front side of the first carrier plate. If the output signals of the miniature microphones M are interconnected that can then permit a directional characteristic of first and higher than first order. Interconnection of the output signals of the miniature microphones can be effected as shown for example in FIGS. 9 through 11.

Thus in accordance with the eighth embodiment there is provided a microphone unit having a housing 810, first and second carrier plates 801, 802 and an intermediate wall 811 between the first and second carrier plates 801, 802. The first and second carrier plates each have a front side and a rear side. A plurality of miniature microphones are provided on each of the front and rear sides of the first and second carrier plates 801, 802. An opening 813 can be provided between the first carrier plate and the intermediate wall 811 and an opening 812 can be provided between the intermediate wall 811 and the second carrier plate. Optionally the output signals of the miniature microphones can be electrically interconnected to permit adjustment of the directional characteristic.

FIG. 9 shows a schematic block circuit diagram of a microphone unit according to the ninth embodiment. The microphone unit has a first plurality of miniature microphones MF on the front side of a carrier plate and a second plurality of microphones MR on the rear side R of the carrier plate. Electrical difference signals of the microphones MF and MR are formed for modelling the directional properties of the microphone unit. In that case the microphone units are arranged on the front and rear sides and are thus spatially separated from each other. The miniature microphones can be arranged on different planes for further spatial distribution.

Figure 9A:
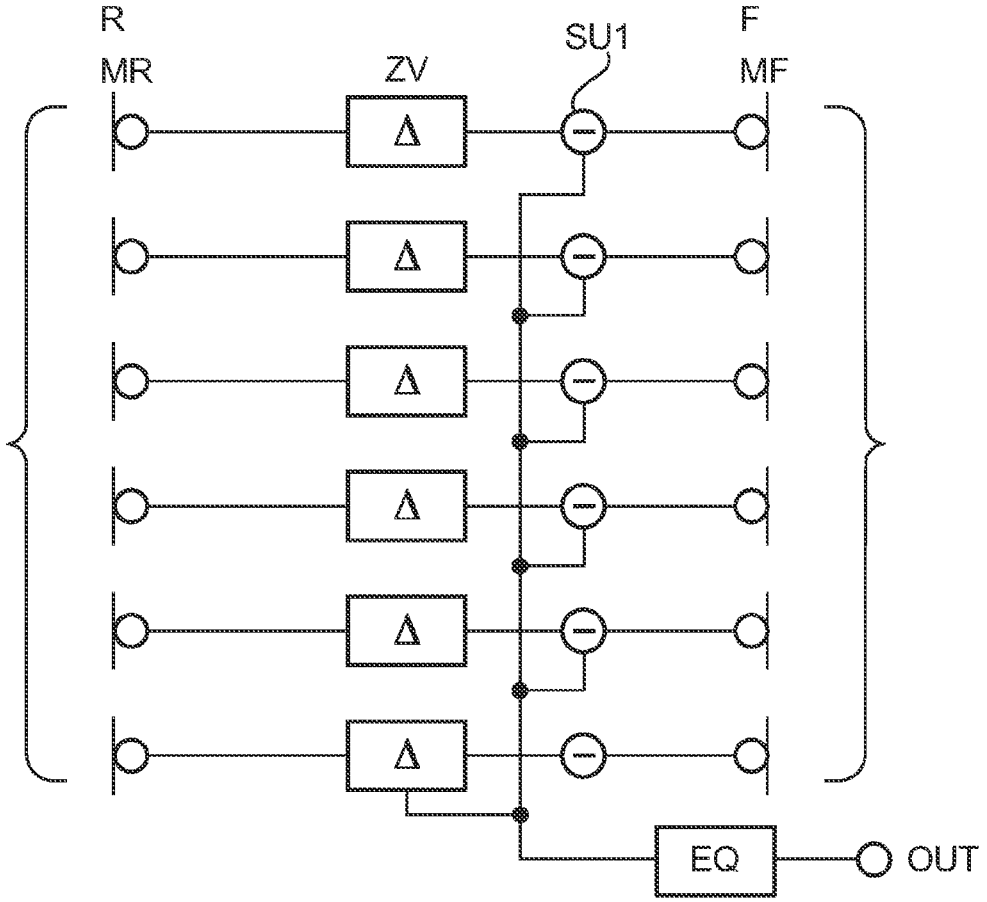
FIGS. 9A and 9B each show a block circuit diagram of a microphone unit according to a ninth embodiment.

In FIG. 9A the output signals of the respective miniature microphones are subtracted from each other, in which case there is a time delay due to the time delay unit in respect of the output signals of the miniature microphones on the rear side of the carrier plate.

Figure 9B:
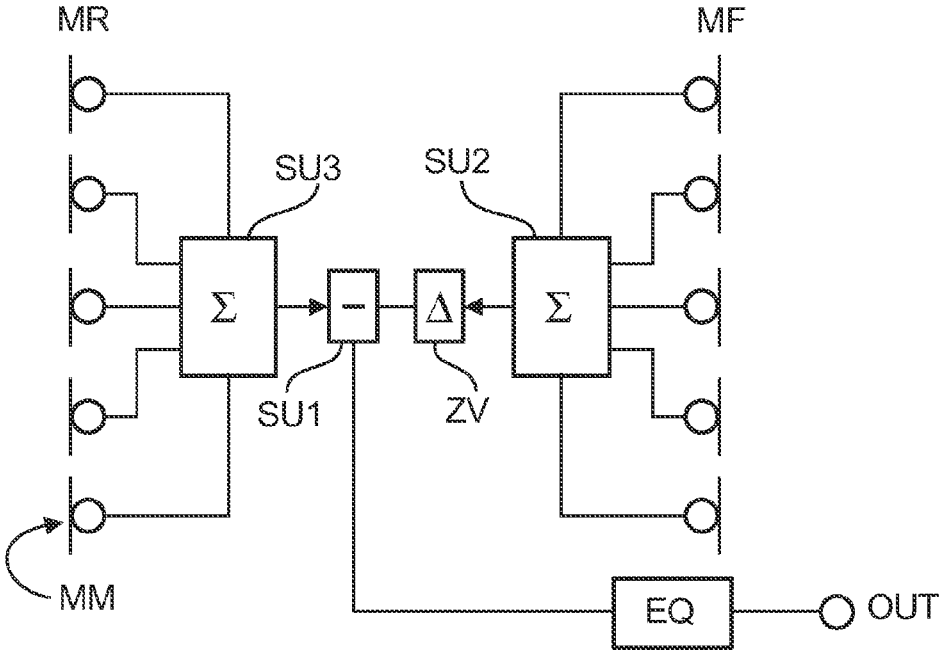

FIG. 9B shows a simple interconnection, wherein after summing of the output signals of the miniature microphones on the front and rear sides a summing unit SU1 implements subtraction of the signals. There can also be a time delay unit ZV to add a time delay to the sum signal.

Figure 10:
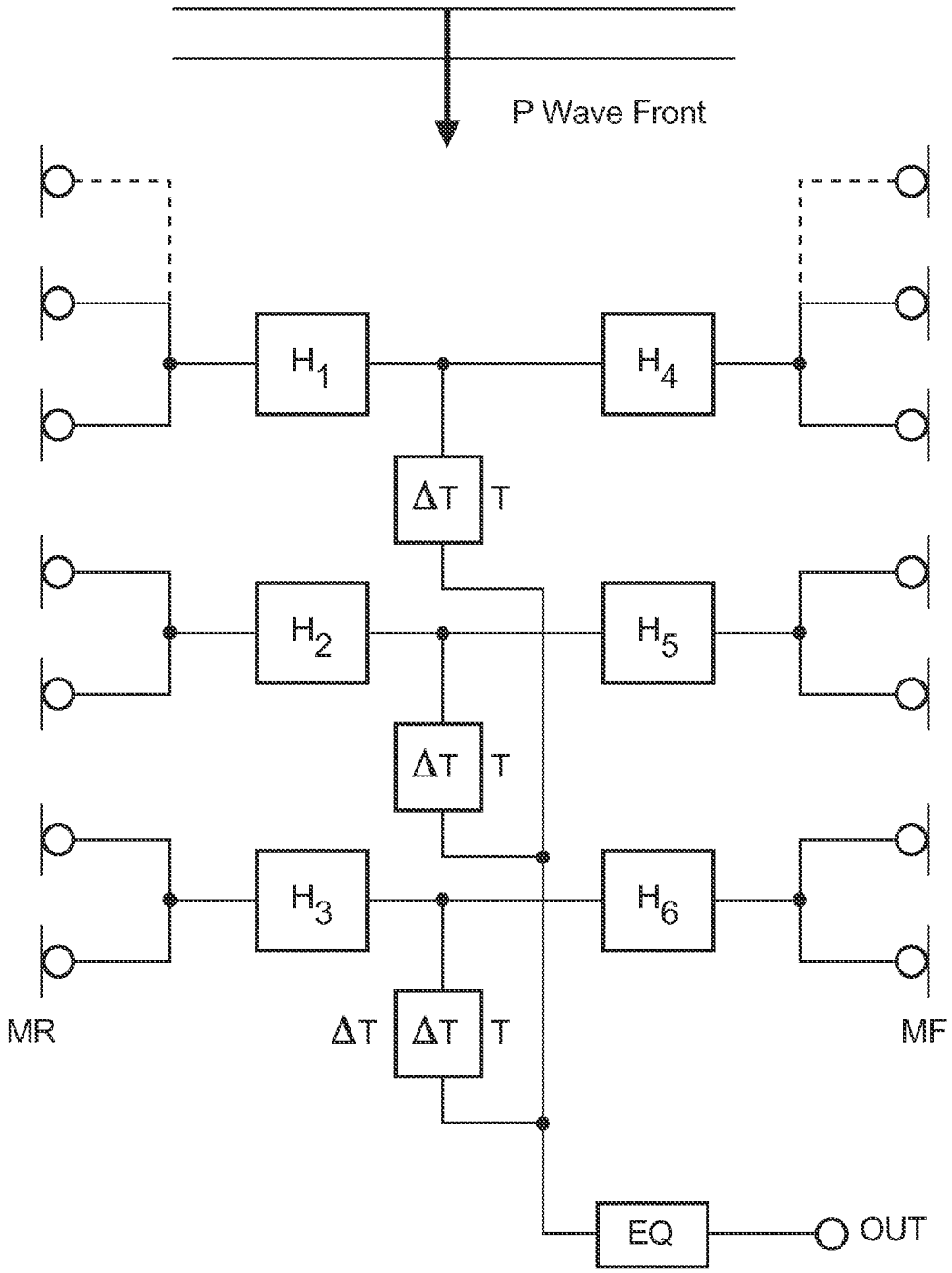
FIG. 10 shows a diagrammatic block circuit diagram of a microphone unit according to a tenth embodiment.

FIG. 10 shows a block circuit diagram of a microphone unit according to a tenth embodiment. The microphone unit has a multiplicity of miniature microphones MF on a front side of the carrier plate and a multiplicity of miniature microphones MR on a rear side of the carrier plate. One or at least two miniature microphones can each be coupled to a respective filter $H_X$. In that case for example three filters $H_1$-$H_3$ can be coupled to the outputs of the miniature microphones MR on the rear side of the carrier plate and three further filters $H_1$-$H_6$ can be coupled to the output signals of the miniature microphones MF on the front side of the carrier plate. The first and fourth filters $H_1$, $H_4$, the second and fifth filters $H_2$, $H_5$ and the third and sixth filters $H_3$, $H_6$ can each be coupled to an equaliser EQ by way of a delay member T.

Thus there can be an interconnection with linear elements filters, transit time members, addition or subtraction of microphone signals, subsegment signal sums or total sums of the microphone unit.

Figure 11:
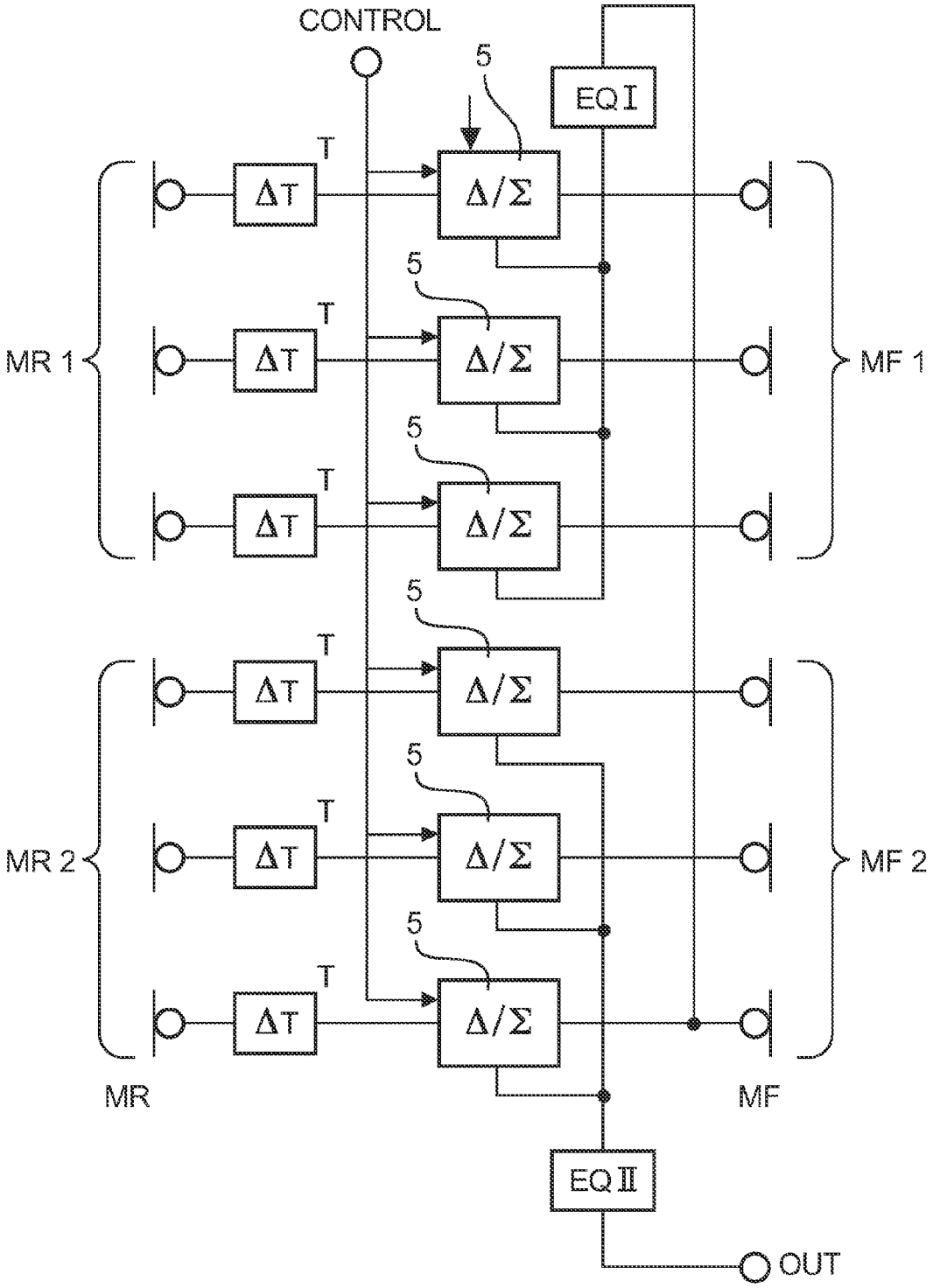
FIG. 11 shows a diagrammatic block circuit diagram of a microphone unit according to an eleventh embodiment.

FIG. 11 shows a block circuit diagram of a microphone unit according to an eleventh embodiment. The microphone unit of the eleventh embodiment has a plurality of miniature microphones MF on the front side and a plurality of miniature microphones MR on the rear side of the carrier plate. The miniature microphones MF on the front side can be subdivided for example into two segments MF1, MF2. The miniature microphones MR on the rear side of the carrier plate can also be subdivided into two segments MR1, MR2. The outputs of the miniature microphones MR on the rear side are outputted by way of a delay unit to a unit 5 which also receives the output signals of the miniature microphones MF on the front side of the carrier plate. In that case the output signals of the units 5 from the miniature microphones in accordance with the first segment are outputted to a first equaliser unit and the output signals of the units 5 for the second segment are outputted to a second equaliser unit. The output signals of the first and second equaliser units are brought together at the output.

In accordance with the first through fourth embodiments the noise performance, the frequency response characteristic and the directional properties can be adjusted by influencing the pressure increase. The solid-borne sound sensitivity can be improved in accordance with the fifth embodiment. The frequency response characteristic can be improved in accordance with the seventh embodiment.

The directional properties of the microphone unit can be adjusted in accordance with the seventh and eighth embodiments.

The directional property of the microphone unit can be made possible by electrical interconnection of the miniature microphones in accordance with the ninth through eleventh embodiments.

The microphone unit according to the invention makes it possible to use inexpensive miniature microphones and novel sound properties can be achieved in that case. In addition production and manufacture of miniature microphones is simpler than the production of microphones with electrostatic, electret or dynamic capsules. The microphone units can also be of a modular structure. The directional and frequency response characteristic properties can also be electrically adjustable with the microphone units according to the invention. Furthermore, the close-talk effect can also be adjustable.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. A microphone unit comprising:

a first plurality of miniature microphones for respectively recording audio signals;

a second plurality of miniature microphones for respectively recording audio signals;

a housing;

an acoustic resistor; and a carrier unit in the form of a printed circuit board comprising;

a front side; and a rear side opposite to the front side;

wherein the first plurality of miniature microphones is arranged on the carrier unit such that the first plurality of miniature microphones is configured for recording a sound pressure on the front side of the carrier unit; and wherein the second plurality of miniature microphones is arranged on the carrier unit such that the second plurality of miniature microphones is configured for recording a sound pressure on the rear side of the carrier unit;

wherein the carrier unit is provided within the housing; and wherein the acoustic resistor is configured to close off a rear volume in front of the rear side of the carrier unit inside the housing thereby producing a sound pressure difference between the front side and the rear side of the carrier unit.

2. The microphone unit as set forth in claim 1;

wherein the carrier unit further comprises a perforation region in which there is provided an acoustic impedance.

3. The microphone unit as set forth in claim 1;

wherein a part of the housing provides an acoustic alternate routing unit configured to produce a sound pressure difference between the front side and the rear side of the carrier unit.

4. The microphone unit as set forth in claim 1;

wherein the carrier unit further comprises:

a plurality of bores;

wherein at least one of the first plurality of miniature microphones and the second plurality of miniature microphones is arranged so that the first plurality of miniature microphones or the second plurality of miniature microphones each close an end of a respective one of the plurality of bores.

5. The microphone unit as set forth in claim 1, further comprising:

at least one resonator in front of at least one of the front side and the rear side of the carrier unit;

wherein the at least one resonator is acoustically coupled to at least a partial segment of the first plurality of miniature microphones or the second plurality of miniature microphones.

6. The microphone unit as set forth in claim 5;

wherein at least two resonators are provided on the front side of the carrier unit, the rear side of the carrier unit, or a combination thereof; and wherein a respective resonator is acoustically coupled only to a partial segment of the plurality of miniature microphones.

7. The microphone unit as set forth in claim 1, further comprising:

an interference tube which is arranged in front of the front side of the carrier unit, and is acoustically coupled to the microphone unit.

8. The microphone unit as set forth in claim 1, further comprising:

a third plurality of miniature microphones; and a second carrier unit in the form of a printed circuit board comprising:

a front side; and a rear side opposite to the front side;

wherein the third plurality of miniature microphones is arranged on the second carrier unit such that the third plurality of miniature microphones is configured for recording a sound pressure on the front side of the second carrier unit; and wherein the second carrier unit is provided within the housing.

9. The microphone unit as set forth in claim 1, further comprising:

a first summing unit configured to sum output signals of the first plurality of miniature microphones;

a second summing unit configured to sum output signals of the second plurality of miniature microphones;

a third summing unit configured to subtract the output signals of the first and second summing units; and a delay unit configured to delay the output signals of the first or second summing unit.

10. The microphone unit as set forth in claim 1, further comprising:

a plurality of time delay units configured to time delay output signals of the second plurality of miniature microphones; and a plurality of summing units configured to subtract output signals of the first plurality of miniature microphones from the time-delayed output signals of the second plurality of miniature microphones.

11. The microphone unit as set forth in claim 1;

wherein at least one of the first plurality of miniature microphones and the second plurality of miniature microphones are respectively divided into at least two segments which are processed at least partially independently of each other.

* * * * *